US010808411B2

(12) United States Patent
Rosati

(10) Patent No.: US 10,808,411 B2
(45) Date of Patent: Oct. 20, 2020

(54) FORMWORK ASSEMBLY WITH INTERLOCKING SIDE FRAME MEMBERS

(71) Applicant: FORM 700 PTY LTD, Altona, Victoria (AU)

(72) Inventor: Emilio Rosati, Altona (AU)

(73) Assignee: Form 700 Pty Ltd, Alton (AU)

( * ) Notice: Subject to any disclaimer, the term of this patent is extended or adjusted under 35 U.S.C. 154(b) by 0 days.

(21) Appl. No.: 16/320,600

(22) PCT Filed: Jul. 18, 2017

(86) PCT No.: PCT/AU2017/000149
§ 371 (c)(1),
(2) Date: Jan. 25, 2019

(87) PCT Pub. No.: WO2018/018063
PCT Pub. Date: Feb. 1, 2018

(65) Prior Publication Data

US 2019/0169864 A1 Jun. 6, 2019

(30) Foreign Application Priority Data

Mar. 3, 2017 (AU) ..... 2017900736

(51) Int. Cl.
*E04G 11/08* (2006.01)
*E04G 9/02* (2006.01)
(Continued)

(52) U.S. Cl.
CPC ..... *E04G 11/08* (2013.01); *E04G 9/02* (2013.01); *E04G 11/10* (2013.01); *E04G 17/04* (2013.01); *E04G 2009/025* (2013.01)

(58) Field of Classification Search
CPC ..... E04G 17/02; E04G 17/04; E04G 11/087; E04G 11/08; E04G 2009/025; E04G 9/02;
(Continued)

(56) References Cited

U.S. PATENT DOCUMENTS 997,647 A * 7/1911 Brust ..... E04G 11/02 249/27
1,151,631 A * 8/1915 Walker ..... E04G 11/12 249/47

(Continued)

FOREIGN PATENT DOCUMENTS

CA 2204558 A1 12/1997
CN 204326519 U 5/2015
CN 105421708 A * 3/2016 ..... E04C 2/388

OTHER PUBLICATIONS

International Search Report and Written Opinion dated Nov. 22, 2017, issue in corresponding Application No. PCT/AU2017/000149, filed Jul. 18, 2017, 8 pages.

*Primary Examiner* — Michael Safavi

(74) *Attorney, Agent, or Firm* — Christensen O'Connor Johnson Kindness PLLC

(57) ABSTRACT

This disclosure relates to a formwork element and a formwork assembly, that can be used to mould upwardly extending building features such as columns or walls that extend between adjacent floor slabs. In one form, the formwork assembly comprises at least two surface forming elements, wherein each surface forming element comprises a casting surface and a pair of lengthwise extending parallel edges. In use, the surface forming elements are stacked by abutting along these edges, and each of these edges comprises a means for interlocking the surface forming elements with respect to each other so that the resulting formwork assembly forms a single, continuous casting surface.

16 Claims, 13 Drawing Sheets

(51) Int. Cl.
*E04G 17/04* (2006.01)
*E04G 11/10* (2006.01)

(58) Field of Classification Search
CPC ..... E04G 9/05; E04G 9/06; E04C 2002/3488; E04C 2/384; E04C 2/386; E04C 2/388; E04B 2/7451; E04B 2/7422; E04B 2/7448
USPC ..... 249/44, 47, 192, 196; 52/591.4, 592.1, 52/591.5, 802.1, 802.11, 800.1, 800.11, 52/801.1
See application file for complete search history.

(56) References Cited

U.S. PATENT DOCUMENTS 1,236,824 A * 8/1917 Davis ..... E04G 15/02 249/39
2,447,272 A * 8/1948 Parkes ..... E04B 1/6104 52/578
2,801,454 A * 8/1957 Troiel ..... E04G 9/06 249/190
3,512,324 A * 5/1970 Reed ..... E04F 15/02405 52/588.1
3,529,389 A * 9/1970 Wilkins ..... E04B 1/6125 174/497
3,859,000 A * 1/1975 Webster ..... B63B 35/34 404/41
4,573,303 A * 3/1986 Figari ..... E04B 5/263 264/35
5,255,888 A * 10/1993 Workman ..... E04G 13/021 249/165
5,305,567 A * 4/1994 Wittler ..... E04B 2/7425 160/135
5,348,778 A * 9/1994 Knipp ..... B32B 3/06 312/400
5,373,678 A * 12/1994 Hesser ..... E04C 2/292 52/309.2
5,375,810 A * 12/1994 Mathis ..... E04G 17/14 249/192
5,425,210 A * 6/1995 Zafir ..... E04C 2/292 52/309.4
5,870,867 A * 2/1999 Mitchell ..... E04B 2/7457 52/220.1
6,443,418 B1 * 9/2002 Itamochi ..... E02D 27/02 249/190
6,581,898 B2 * 6/2003 McCracken ..... E04G 9/06 249/189
6,588,171 B2 * 7/2003 Pryor ..... E04B 1/08 52/269
6,769,835 B2 * 8/2004 Stridsman ..... E04F 15/02 404/41
8,590,252 B2 * 11/2013 Cordeiro ..... E04F 13/0894 52/588.1
8,997,436 B2 * 4/2015 Spear ..... E04F 13/0894 52/239
9,890,541 B2 * 2/2018 Hullenkremer ... E04F 15/02011
2002/0189182 A1 * 12/2002 Record ..... E04C 2/288 52/309.9
2006/0032168 A1 * 2/2006 Thiers ..... E04F 15/02 52/390
2014/0093677 A1 * 4/2014 Permesang ..... E04F 15/02038 428/99

* cited by examiner

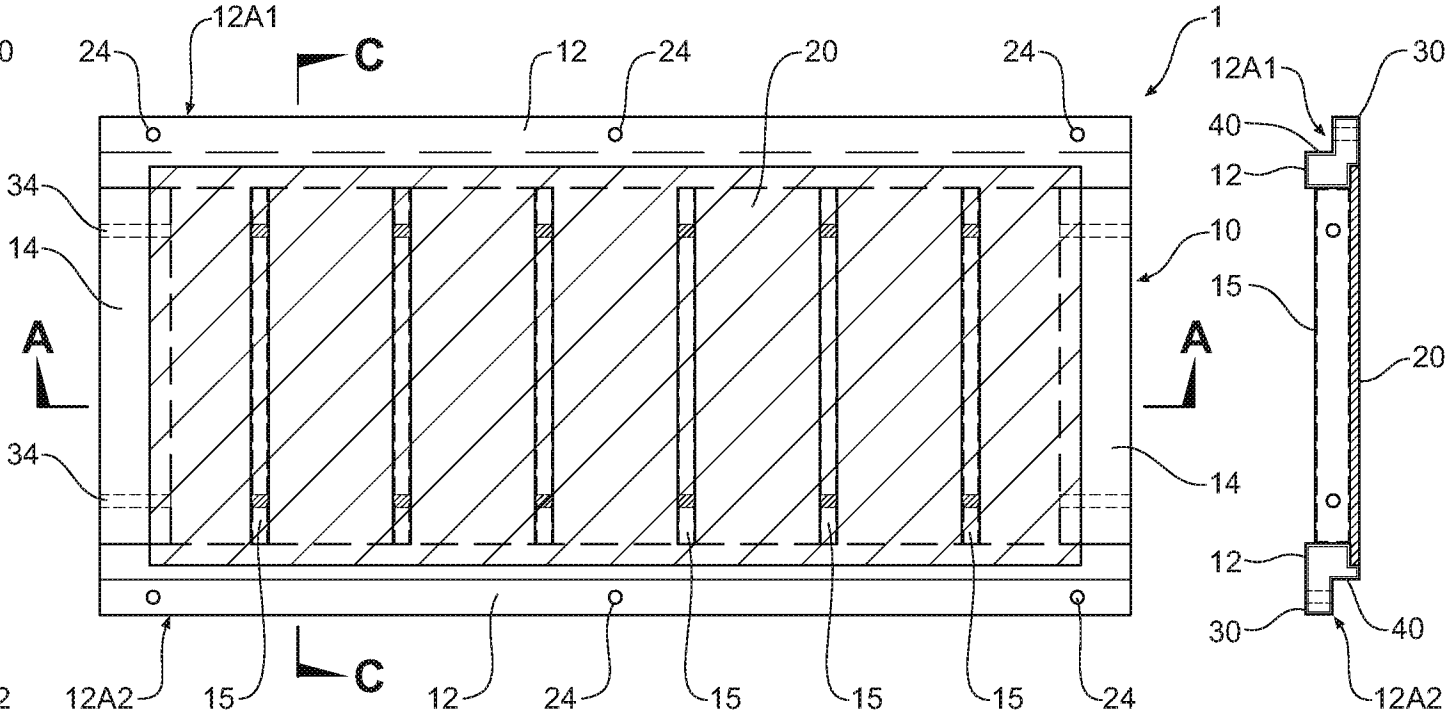
Figure 1
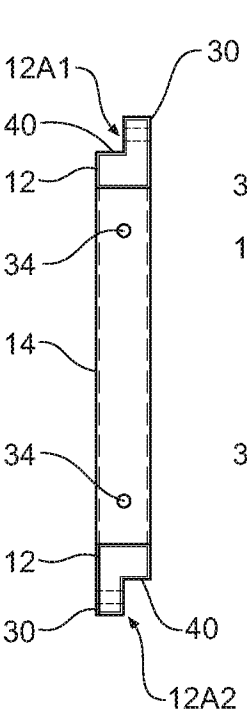
Figure 2
Figure 3
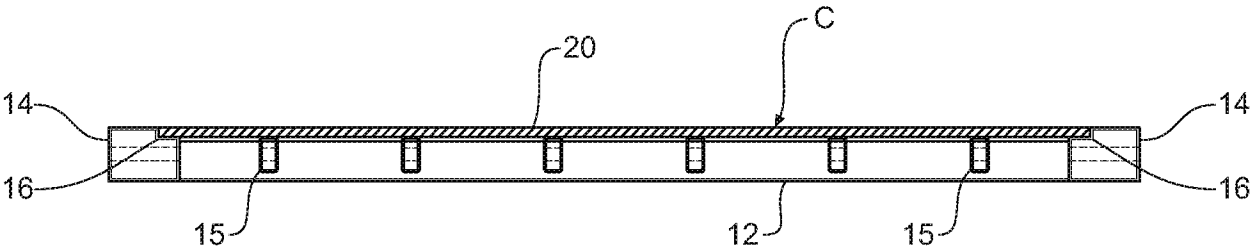
Figure 4

FORMWORK ASSEMBLY WITH INTERLOCKING SIDE FRAME MEMBERS

INCORPORATION BY REFERENCE

The following co-pending patent application is hereby incorporated by reference in its entirety: International Patent Application No. PCT/AU2015/000594 titled "A FORMWORK PANEL ASSEMBLY" in the name of Form 700 Pty Ltd.

PRIORITY DOCUMENTS

The present application claims priority from:

Australian Provisional Patent Application No. 2016902953 titled "IMPROVED FORMWORK ASSEMBLY" and filed on 27 Jul. 2016; and Australian Provisional Patent Application No. 2017900736 titled "IMPROVED FORMWORK ASSEMBLY" and filed on 3 Mar. 2017;

the content of each of which is hereby incorporated by reference in its entirety.

TECHNICAL FIELD

This disclosure relates to a formwork assembly for moulding upwardly extending building features such as columns or walls that extend between adjacent floor slabs.

BACKGROUND

Construction of multi-storey concrete buildings involves sequential floor by floor casting of concrete structures. In order to cast building components such as floor slabs, columns and other features, a casting structure referred to as formwork is used to progressively advance the building upwardly, floor by floor.

This generally involves using a lower floor slab as a support platform for formwork to cast the next floor slab above. In order to support an upper floor slab, upwardly extending building features such as columns and internal walls are also cast to support the upper floor slab once the formwork is removed.

Formwork to create a floor slab will comprise horizontal elements that are positioned between vertical building features such as columns and walls that extend between floor slabs. Reinforced concrete uses reinforcing steel in the form of steel rods, steel frames and mesh, which is positioned on and within formwork prior to pouring of concrete. In the case of vertical building features, the reinforcing framework must extend above and clear of the slab, so that it is in turn, exposed to allow attachment of further upwardly extending reinforcement formwork. This allows extension of reinforcement frames for the progressive casting of vertical features such as columns or walls.

Only once the lower floor slab is formed, can the formwork for the vertical feature, be this a column, a wall or the like, be put in place around the reinforcing steel frame work, ready for casting of the vertical feature above the new floor level.

This causes a delay in setting up the formwork required for the next floor slab. It is necessary for the concrete within the columns or other vertical features to set prior to removal of the formwork, which then enables the formwork for the next floor slab to be put in place. Obviously, the formwork for the next floor slab needs to abut against the vertical features so as to incorporate them in the upwardly extending building structure.

Current column or wall formwork cannot be used concurrently with floor slab formwork, as the column or wall formwork could not be removed. Because this column or wall formwork must extend from the floor surface of the lower slab to the underside surface of the upper floor slab, it is wedged in place between these two concrete surfaces. The formwork would need to be destroyed or broken to be removed.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided a formwork assembly for moulding an upwardly extending building feature comprising at least two surface forming elements for forming one side of said building feature, wherein each surface forming element comprises a casting surface and a pair of lengthwise extending parallel edges, wherein in use, the surface forming elements are stacked by abutting along these edges, and each of these edges comprise a means for interlocking the surface forming elements with respect to each other so that the resulting formwork assembly forms a single, continuous casting surface.

That is to say, in one form, in use, the surface forming elements extend substantially horizontally.

According to a further aspect, there is provided a surface forming element for a formwork assembly for moulding an upwardly extending building feature and comprising at least two surface forming elements, where each surface forming element comprises a casting surface, and a pair of lengthwise extending parallel edges, wherein in use, the surface forming elements are stacked by abutting along these edges, and each of these edges comprise a means for interlocking the surface forming elements with respect to each other so that the resulting formwork assembly forms a single, continuous casting surface.

In one form, each surface forming element comprises a panel assembly.

In one form, the interlocking means for each lengthwise extending parallel edge comprises at least one projection and at least one recess, wherein in use, interlock is effected by engagement of the projection of one element with the recess of the other, and vice versa.

In one form, the means for interlocking the abutting formwork elements comprises a profile shape of the edges.

In one form, the profile shape is substantially constant throughout the length of the surface forming element.

In one form, the profile shape comprises a single projection and a single recess.

In one form, for each surface forming element, the profile shape of the two edges differs inasmuch as a profile shape of a first of the edges is an inversion of the other of the edges.

In one form, the profile shape comprises a step, and step-shaped recess adjacent to the step, where this step-shaped recess is shaped to receive a step of a further surface forming element.

In one form, in an alternative, the interlocking means for each lengthwise extending parallel edge comprises a plurality of projections and recesses spaced apart lengthwise along the edges. In one form, the projections comprise prongs or teeth, and the recesses comprise apertures for receiving the prongs or teeth.

In one form, each surface forming element comprises a means for securing a pair of stacked surface forming elements with respect to each other.

In one form, each surface forming element comprises a means for securing a pair of surface forming elements with respect to each other in an end to end relationship.

In one form, pins or fasteners such as bolts or screws extend through aligned holes in the adjacent frame members to secure the two surface forming elements together.

In one form, in an alternative, each surface forming element comprises a catch for securing the two surface forming elements together.

As will be appreciated in the above description, in use, the formwork assembly can extend from an upper surface of a lower floor slab to an underside surface of a floor slab above. This formwork assembly will be held captive between these surfaces until the uppermost surface forming element is removed, thereby allowing successive removal of the remaining surface forming elements from the newly formed concrete surface.

In one form, each of the surface forming elements comprises a rectilinear perimeter frame and an infill panel.

In one form, the perimeter frame comprises a border extending about a perimeter of the infill panel so as to form the continuous casting surface along with the infill panel.

In one form, the border is made of a more wear resistant material than the infill panel.

In one form, the border is made from a metal, and the board is made from one of a timber, a plywood, a plastic or a composite.

In one form, the frame comprises a pair of lengthwise extending parallel side members, a pair of end members, and a plurality of spaced apart bracing members bridging the side members.

In one form, the lengthwise extending parallel side members of the frame comprise a plurality of apertures spaced apart there along, for receiving threaded fasteners, pins or the like to secure a pair of stacked surface forming elements with respect to each other.

In one form, the end members of the frame comprise apertures for receiving threaded fasteners or pins or the like to secure a pair of surface forming elements with respect to each other endwise.

In one form, the formwork assembly further comprises an edge element at the bottom, at least, of each stack of surface forming elements.

In one form, the formwork assembly further comprises an edge element at the top of each stack of surface forming elements.

In one form, each edge element comprises a pair of lengthwise extending parallel side edges, where a first side edges comprises a square edge for forming an end edge, and a second side edge comprises a profile shape identical to that of the surface forming element, so that a surface forming element can be stacked atop of, and interlock with this second side edge.

In one form, the interlocking feature comprises either of a male or a female feature or portion, where the male feature or portion is adapted to engage the female feature or portion. In other words, the interlocking feature comprises either of a projection or a recess, where the projection is adapted to interlock with the recess and vice versa.

For a given area to be formed, a number of surface forming elements can be used, which in turn reduces the size and weight of each surface forming element. This greatly assists in easier manual handling of the various elements forming the assembly.

The width (or height when in use) of each surface forming element will be determined by the number of panels used and the distance between the upper surface of the lower floor and the underneath surface of the upper floor being formed. The length of the surface forming elements will depend on the type of vertical feature being created. For example, columns will require shorter lengths by comparison to internal walls which will require longer lengths.

An internal wall may be formed by using a pair of formwork panel assemblies spaced apart by the required thickness of the wall. Additional formwork can be placed so as to extend between the pair of formwork assembly panels at each end and held in place to form the ends of the walls. Ties can extend between the pair of formwork assembly panels to hold them together under the weight of the concrete, and the formwork forming the ends of the walls can be braced with respect to the pair of formwork panel assemblies.

In the case of forming a column, the formwork assembly panels can be connected along abutting edges and ties can extend between opposing pairs of formwork panel assemblies. Alternatively, a bracing frame can be formed around the assembled formwork panels to hold them in position.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF DRAWINGS

Embodiments of the present invention will be discussed with reference to the accompanying drawings wherein:

FIG. 1 illustrates a front view of a surface forming element;

FIG. 2 is an end view of the surface fainting element of FIG. 1;

FIG. 3 is a cross-sectional view through the surface forming element of FIG. 1, taken at C-C;

FIG. 4 is a cross-sectional view through the surface forming element of FIG. 1, taken at A-A;

In the following description, like reference characters designate like or corresponding parts throughout the figures.

DESCRIPTION OF EMBODIMENTS

Figure 5:
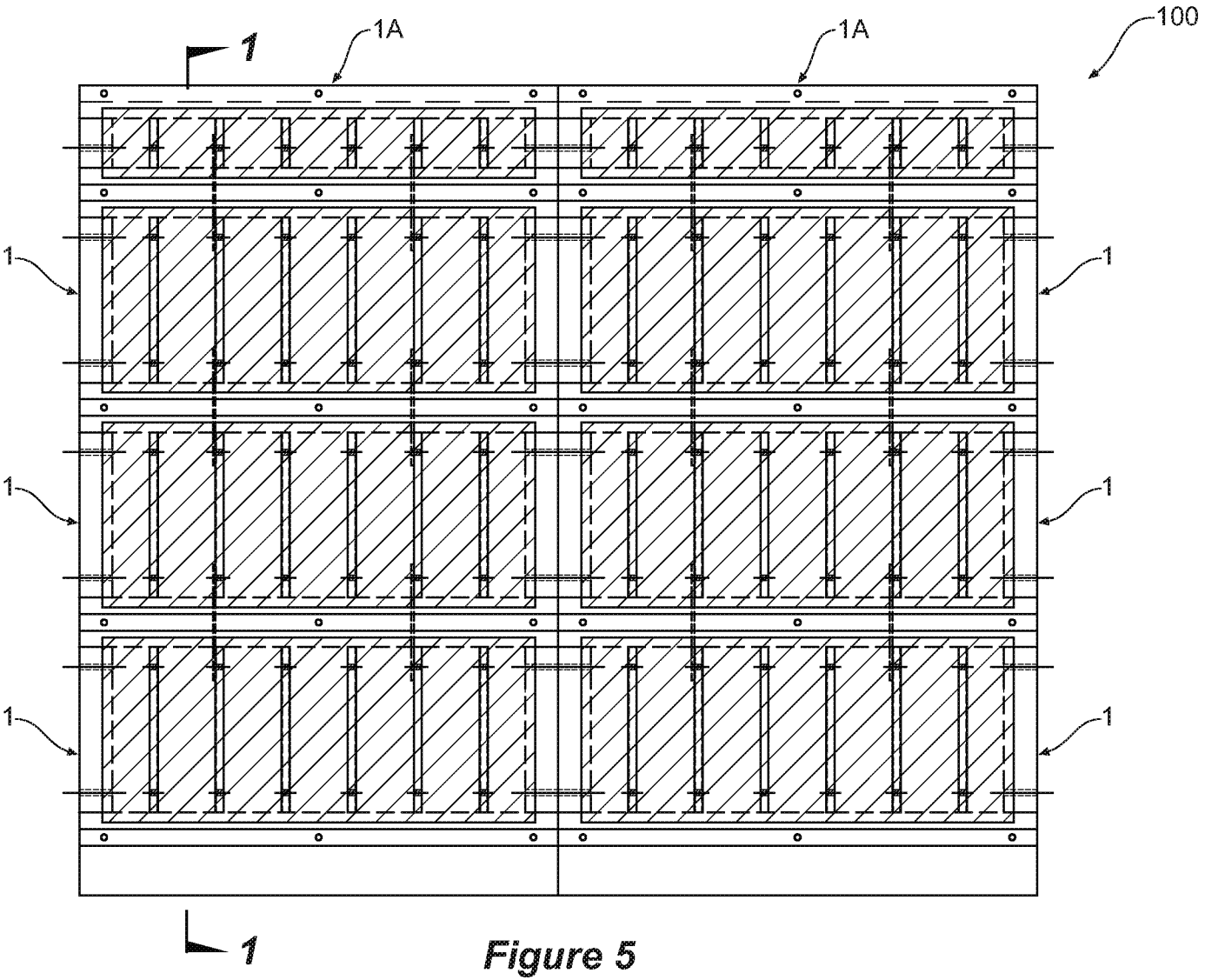
FIG. 5 illustrates a front view of a formwork assembly for moulding an upwardly extending building feature, the formwork assembly comprising a plurality of the surface forming elements of FIG. 1.

Referring now to FIGS. 1 through 4, where there is illustrated a surface forming element 1 according to an embodiment.

The surface forming element 1 comprises a generally rectilinear and elongate panel, a perimeter frame 10 and an infill panel 20. The frame 10 comprises a pair of lengthwise extending parallel side members 12, a pair of end members 14, and a plurality of spaced apart bracing members 15 bridging the side members 12.

With reference to FIGS. 3 and 4, it can be seen that each of the side members 12 and end members 14 of the perimeter frame 10 comprises a rebate 16 (or step-shaped recess) shaped to receive an edge of the infill panel 20. In this way, the perimeter frame 10 comprises a border extending about a perimeter of the infill panel 20 so as to form a flush, continuous casting surface C along with the infill panel 20.

In this embodiment, the infill panel 20 is made of a material such as plywood, having a thickness of approximately 12 millimetres, but other materials (such as corflute or FRP) of varying thicknesses (depending on strength) may also be used.

Figure 6:
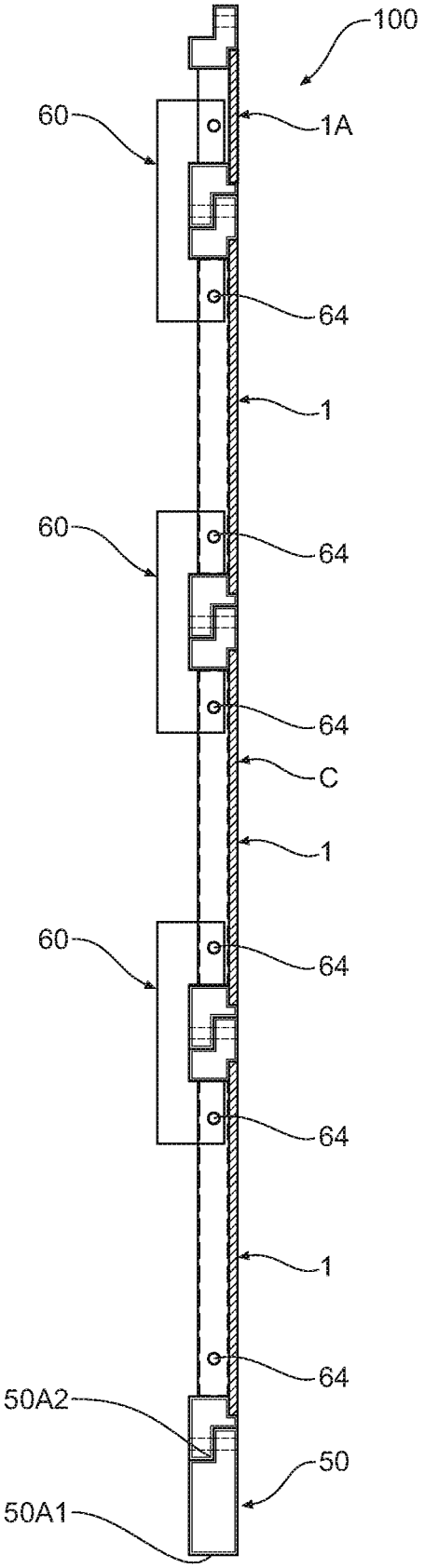
FIG. 6 is a cross-sectional view through the formwork assembly of FIG. 5, taken at 1-1.
Figure 9:
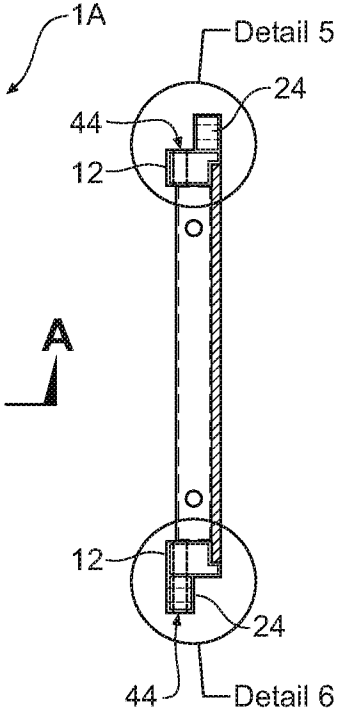
FIG. 9 is a cross-sectional view through the surface forming element of FIG. 7, taken at C-C.
Figure 7:
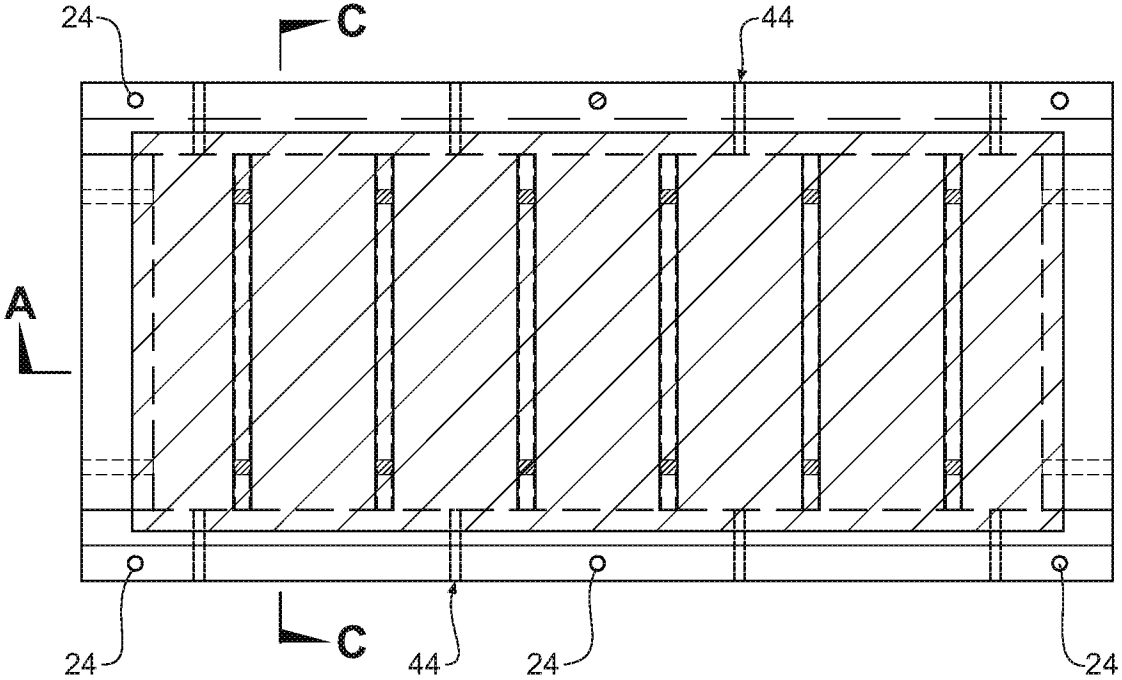
FIG. 7 illustrates a front view of a surface forming element according to a further embodiment.
Figure 8:
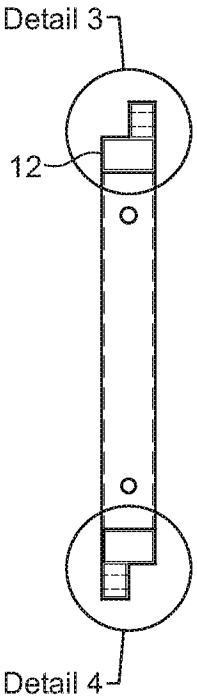
FIG. 8 is an end view of the surface fainting element of FIG. 7.
Figure 10:
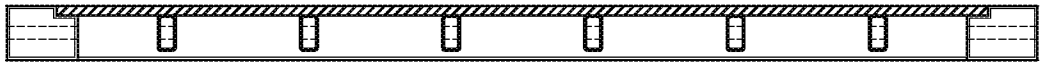
FIG. 10 is a cross-sectional view through the surface forming element of FIG. 7, taken at A-A.
Figure 11:
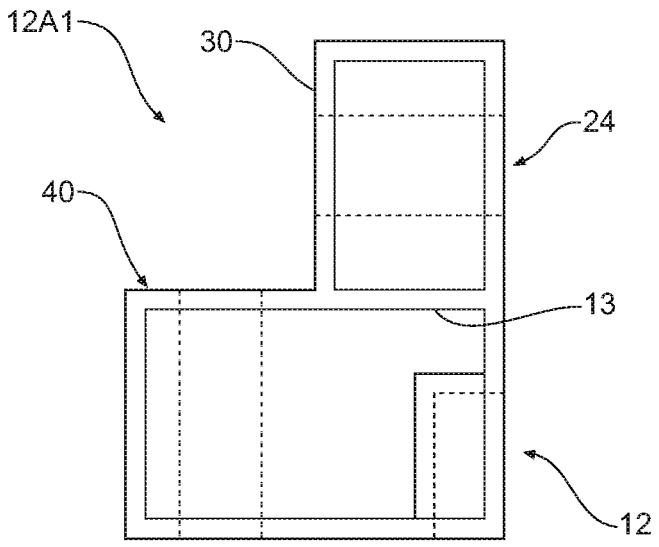
FIG. 11 is a detail view taken at Detail 3 in FIG. 8.
Figure 12:
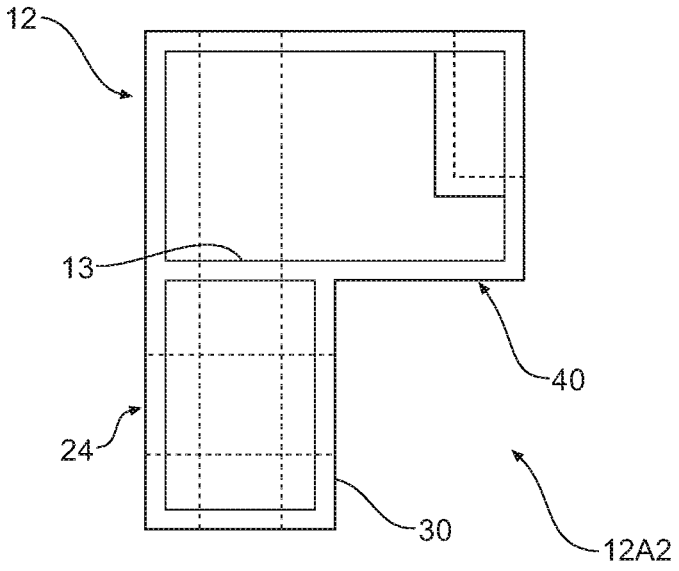
FIG. 12 is a detail view taken at Detail 4 in FIG. 8.
Figure 13:
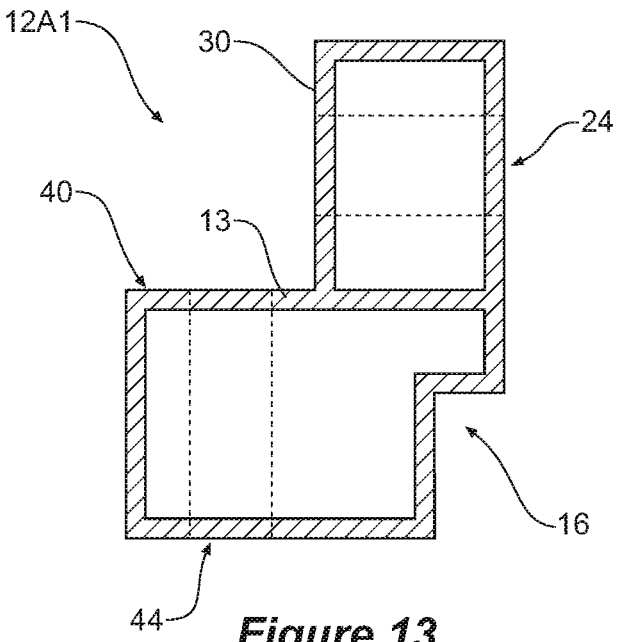
FIG. 13 is a detail view taken at Detail 5 in FIG. 9.
Figure 14:
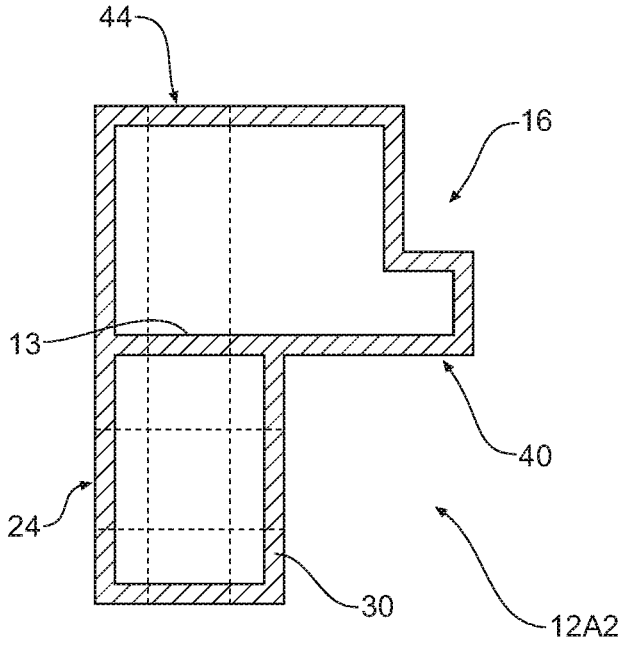
FIG. 14 is a detail view taken at Detail 6 in FIG. 9.

Referring now to FIGS. 5 and 6, where there is illustrated a formwork assembly 100 according to an embodiment. The formwork assembly 100 comprises six of the surface forming elements 1, arranged into two abutting stacks of three surface forming elements 1 each, wherein each surface forming element 1 comprises a pair of lengthwise extending parallel side edges 12A, and wherein the surface forming elements 1 are stacked by abutting along these side edges 12A.

It should be understood that a formwork assembly 100 can comprise as many surface forming elements 1 arranged in as many stacks as is required for the particular application.

To facilitate this stacking, each of these edges 12A comprise a means for interlocking the surface forming elements 1 with respect to each other so that the resulting formwork assembly 100 forms a single, continuous casting surface C.

With reference to FIGS. 2 and 3, it can be seen that in this embodiment, the interlocking means comprises a profile shape of the edges 12A, and more specifically, a cross-sectional shape of the side members 12, where this cross-sectional shape is substantially constant throughout the length of the side members 12, and the surface forming element 1.

In this embodiment, each profile shape comprises a squared, step-shape comprising a (male or projecting) step 30, and a (female) step-shaped recess 40 adjacent to the step 30, where this step-shaped recess 40 is shaped to receive a step 30 of a further surface forming element 1.

For each surface forming element 1, the profile shape of the two edges 12A differs inasmuch as a profile shape of a first of the edges 12A1, is an inversion of the other of the edges 12A2. That is to say, for a profile shape of a first of the edges 12A1 the male step 30 extends along the continuous casting surface C, and the step-shaped recess 40 of the other of the edges 12A2 extends along the continuous casting surface C, and vice-versa.

In use, the male step 30 extending along edge 12A1 of a first surface forming element 1, is received in the recess 40 along the lower edge 12A2 of a further surface forming element 1 stacked atop of the first surface forming element 1. In this way, overlapping joints are formed that prevent egress of concrete while at the same time providing a smooth and flush continuous casting surface C against which concrete can be moulded, when the surface forming elements 1 are assembled.

The frame 10 is constructed primarily from a tubular aluminium (although other materials may be used), because this material can be extruded to produce the required cross-sectional shapes.

Being made of a harder, more wear resistant material than that of the infill panel 20 means that the perimeter frame 10 is less susceptible to damage resulting from normal handling and positioning of surface forming elements 1, than would be the infill panel 20 if this extended beyond the edge of the perimeter frame 10.

The lengthwise extending side members 12 of the frame 10 comprise a plurality of apertures 24 spaced apart there along, for receiving threaded fasteners, pins or the like.

As can be seen in FIG. 6, each aperture 24 extends through the step 30, and in use, the apertures 24 in adjacent surface forming elements 1 align when they are stacked, so that threaded fasteners or pins (not illustrated) can be inserted through the aligned apertures 24 to secure an upper and a lower stacked surface forming element 1 together. The dowels may be threaded (such as by use of Z-tie threads) to clamp the components together.

Similarly, the end members 14 of the frame 10 comprise apertures 34 for receiving threaded fasteners or pins. As illustrated in FIG. 6, these apertures 34 would enable a pair of surface forming elements 10 to be abutted end to end and secured together using threaded fasteners or pins.

With reference to FIGS. 5 and 6, it can be seen that the formwork assembly 100 further comprises a pair of edge elements 50, one each at the bottom (although these could also be used at the top) of the two abutting stacks of three surface forming elements 1. Each edge element 50 comprises a rail of extruded aluminium, and a pair of lengthwise extending parallel side edges 50A.

A first of the lengthwise extending parallel side edges 50A1 comprises a square edge for resting atop of a floor or other surface, and the other lengthwise extending parallel side edges 50A2 comprises a profile shape identical to that of the surface forming element 1, so that a surface forming element 1 can be stacked atop of, and interlock with, the lengthwise extending parallel side edge 50A2.

The formwork assembly 100 further comprises a pair of narrowed surface forming elements 1A, one each at the top of (although these could be used anywhere) the two abutting stacks of three surface forming elements 1. These narrowed surface forming elements 1A are almost identical to the surface forming elements 1 described above, differing in that the distance between the side edges 12A is less. These narrowed surface forming elements 1A can be used in conjunction with the standard surface forming element 1, and enable a required height to be achieved using a combination of these.

With reference to FIG. 6, it can be seen that the formwork assembly 100 further comprises a plurality of couplers 60. Each coupler 60 comprises a generally C-shaped bracket comprising a recess which is sized and shaped to receive a portion of a pair of interlocked side members 12. Each coupler 60 further comprises a pair of apertures 64 for receiving the threaded fasteners or pins that join abutting end members 14. While optional, use of the couplers 60 adds strength and stability to the formwork assembly 100.

As will be seen from the above description, the formwork assembly 100 can be easily assembled from the bottom up so as to put in place formwork which can mould vertical building features between floor slabs. Once the formwork assembly is in place, the formwork forming the underside surface of the upper floor can abut against the upper edge of the formwork assembly 10.

When no longer required, the formwork assembly 100 can be dis-assembled from the top down.

Referring now to FIGS. 7 through 14, where there is illustrated a surface forming element 1A according to a further embodiment. Those parts of the surface forming element 1A which are identical (or near-identical) to corresponding parts shown in the surface forming element 1 of FIGS. 1 through 6, will be denoted by the same reference numerals and will not be described again in detail.

With reference to FIGS. 11 through 14, it can be seen that the lengthwise extending side members 12 of surface forming element 1A differ in that these comprise an internal wall 13 at the point where the step in the profile cross-sectional shape occurs. This internal wall 13 divides the previously L-shaped cavity inside of the lengthwise extending side members 12, into two cavities comprising a generally rectangular cross-sectional shape. In use, the internal wall 13 will both strengthen and stiffen the lengthwise extending side members 12 of surface forming element 1A.

In addition to the apertures 24, the lengthwise extending side members 12 of surface forming element 1A comprise a further set of apertures 44 spaced apart there along, for receiving threaded fasteners, pins or the like. Whereas the apertures 24 extend between inner and outer (relative to the continuous casting surface C) surfaces of the lengthwise extending side members 12, the apertures 44 extend perpendicular to the apertures 24, between upper and lower edges of each lengthwise extending side member 12.

Figures 18, 19, 20:
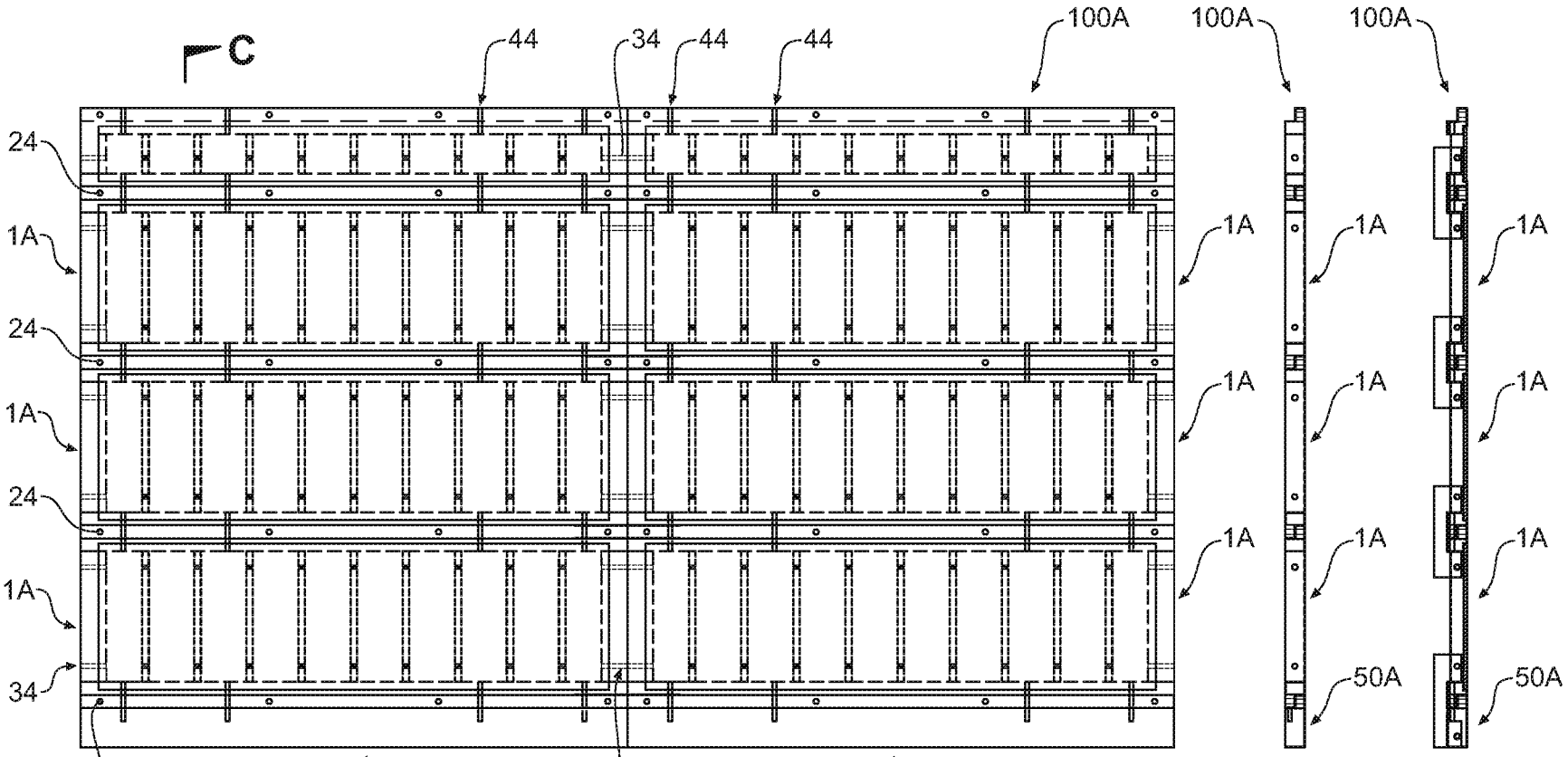
FIG. 18 illustrates a front view of a formwork assembly for moulding an upwardly extending building feature, the formwork assembly comprising a plurality of the surface forming elements of FIG. 1.
FIG. 19 is a side view of the formwork assembly of FIG. 18.
FIG. 20 is a cross-sectional view through the formwork assembly of FIG. 18, taken at C-C.

As can be seen in FIGS. 18 through 20 (which illustrate a formwork assembly 100A), similar to the apertures 24, each aperture 44 extends through the step 30, and in use, the apertures 44 in adjacent surface forming elements 1A align when they are stacked, so that bolts or pins (not illustrated) can be inserted through the aligned apertures 44 to secure an upper and a lower stacked surface forming element 1A together. This improves the strength and the stability of the stacked formwork assembly illustrated in FIGS. 18 through 20.

Figure 15:
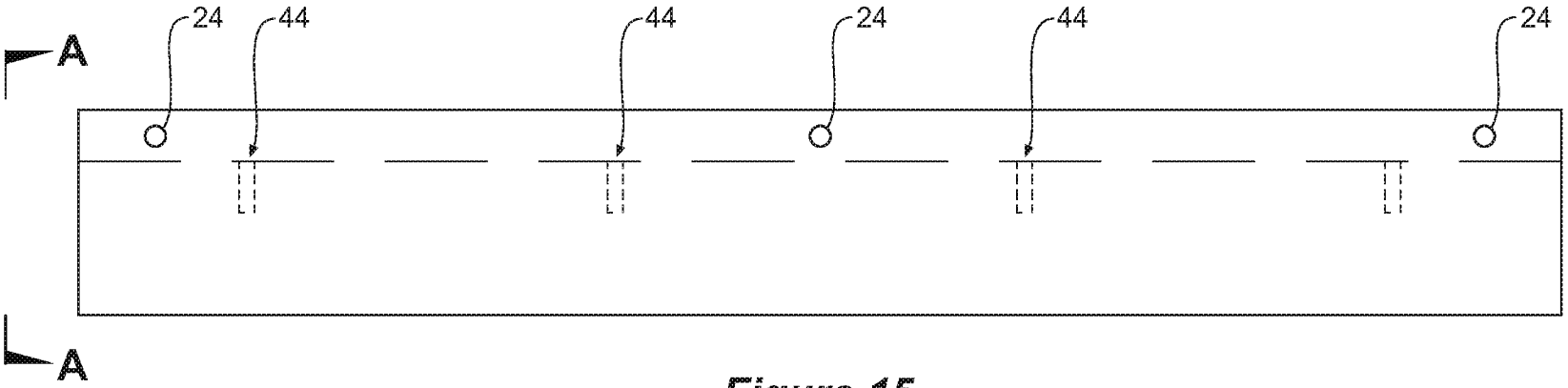
FIG. 15 is a front view of an edge element.
Figure 16:
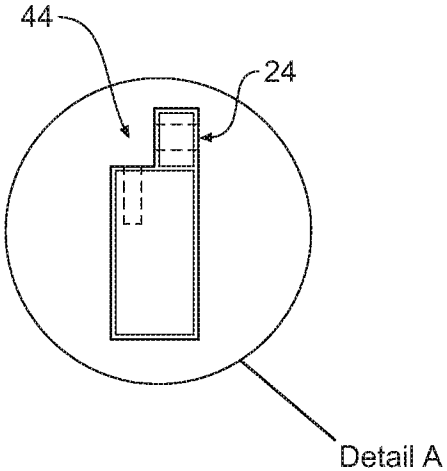
FIG. 16 is a cross-sectional view through the edge element of FIG. 15, taken at A-A.
Figure 17:
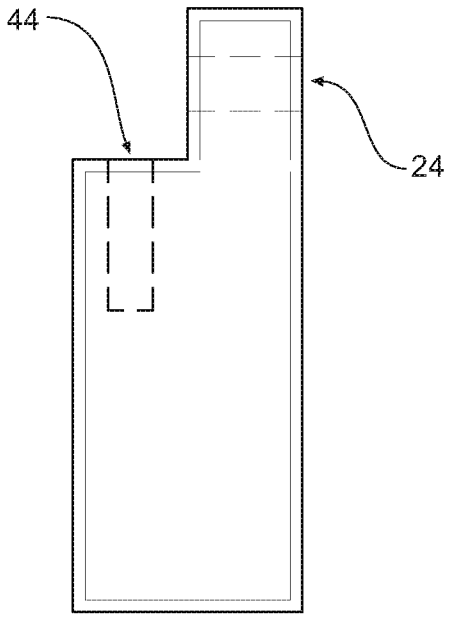
FIG. 17 is a detail view taken at Detail A in FIG. 16.

Referring now to FIGS. 15 through 17, where there is illustrated an edge element 50A. Those parts of the edge element 50A which are identical (or near-identical) to corresponding parts shown in the edge element 50 of FIGS. 5 and 6, will be denoted by the same reference numerals and will not be described again in detail.

Similar to the lengthwise extending side members 12 of surface forming element 1A, the edge element 50A comprises a first set of apertures 24, and a second set of apertures 44, which in use, align with the apertures 24 and 44 respectively, of surface forming elements 1A stacked atop of the edge element 50A, to receive bolts or pins which secure these together.

While not illustrated, a wall or column can be formed by positioning a pair of formwork assemblies in an opposing relationship, and extending horizontal ties between them. Each horizontal tie locates in one of the apertures 24 in the surface forming elements, comprises a Z-tie rod, and resists the weight of the concrete pushing the adjacent formwork panel assemblies apart.

In some instances it will be necessary to form an edge or end of a wall or column between a pair of formwork assemblies 100 arranged in an opposing relationship. In order to facilitate this, a plurality of end brackets 120 and 140 are secured with respect to the surface forming elements 1A, and these end brackets 120 and 140 support beams 160 which bridge (i.e. extend between) the brackets 120 and 140 associated with each of the pair of opposing formwork assemblies 100, and these beams 160 in turn support vertically extending formwork (not illustrated) such as planks or sheets of a suitable material (such as plywood), which will form the edge or end of the wall once the concrete is poured.

Each of the end brackets 120 and 140 comprises a pair of parallel spaced apart arms 150, and a connector 152 which bridges the arms 150, so that collectively, the arms 150 and the connector 152 define a slot 154 therebetween. In use, each of the arms 150 is inserted into an end of one of the contiguous tubular side members 12. An end of one of the beams 160 is then received in the slot 154. The arms 150 comprise holes 158 via which the arms 150 can be pinned or bolted in the side members 12.

Figure 22:
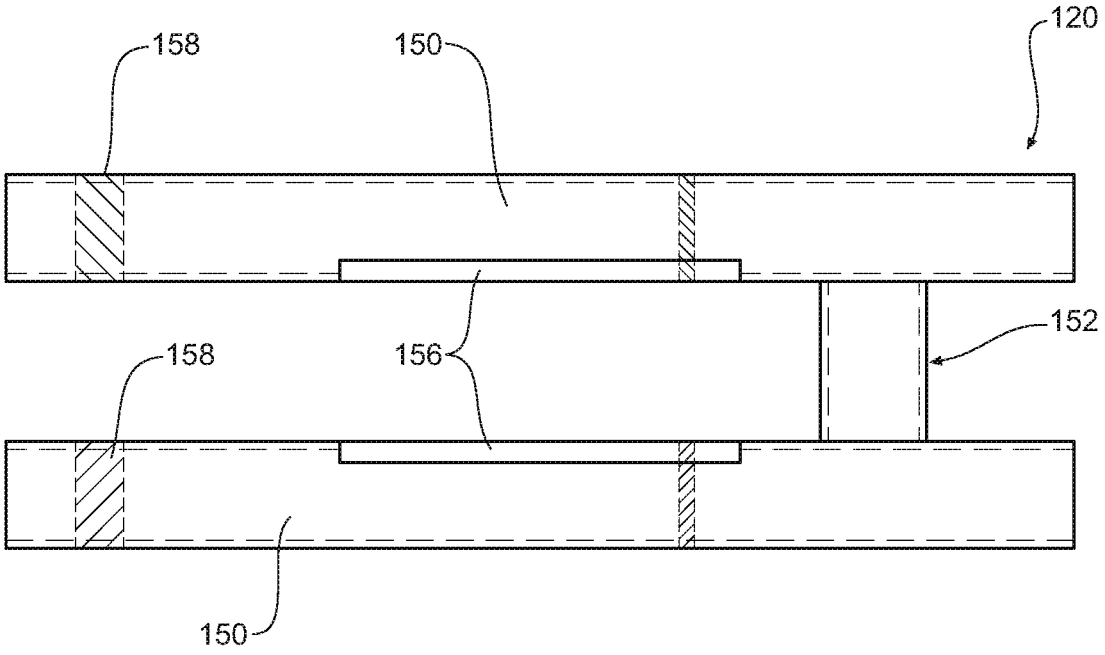
FIG. 22 is a plan view of an end bracket of a first type, from the assembly of FIG. 21.
Figure 23:
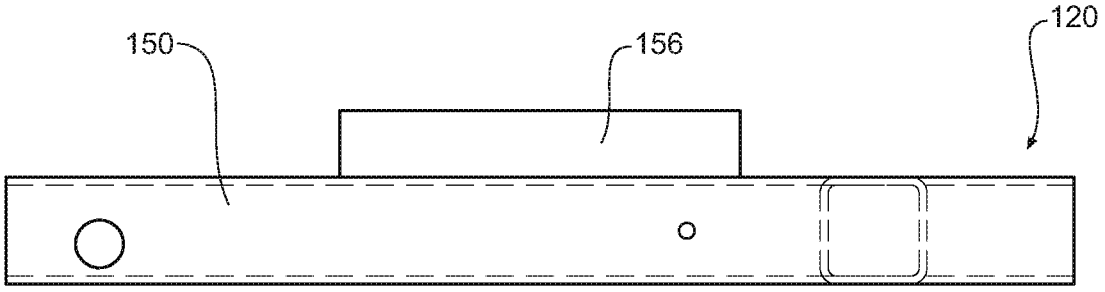
FIG. 23 is a side view of the end bracket of FIG. 22.

With reference to FIGS. 22 and 23, it can be seen that a first type of end bracket 120 comprises arms 150 of square hollow section (SHS) steel, and a connector 152 of SHS steel which is welded at its ends to the arms 150. Each of the arms 150 of end bracket 120 comprises a depth guide 156 which limits the depth to which the arms 150 can be inserted into the tubular side members 12. In this embodiment, this depth guide 156 comprises a length of outwardly projecting steel plate 156 which in use will abut against the rebate 16 for the infill panel 20.

Figure 24:
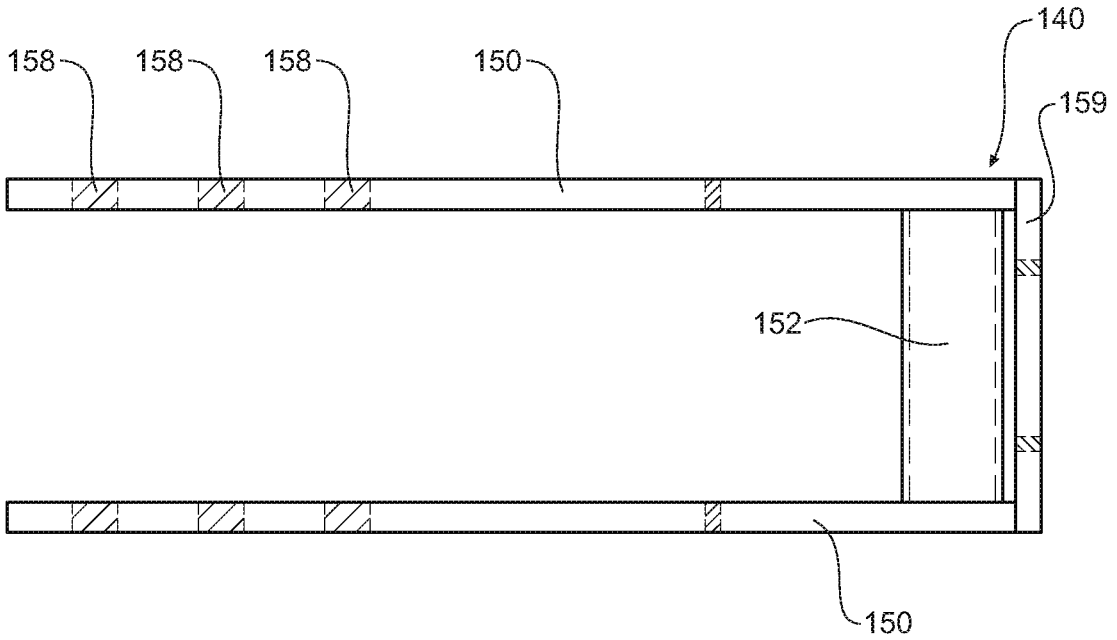
FIG. 24 is a plan view of an end bracket of a second type, from the assembly of FIG. 21.
Figure 25:
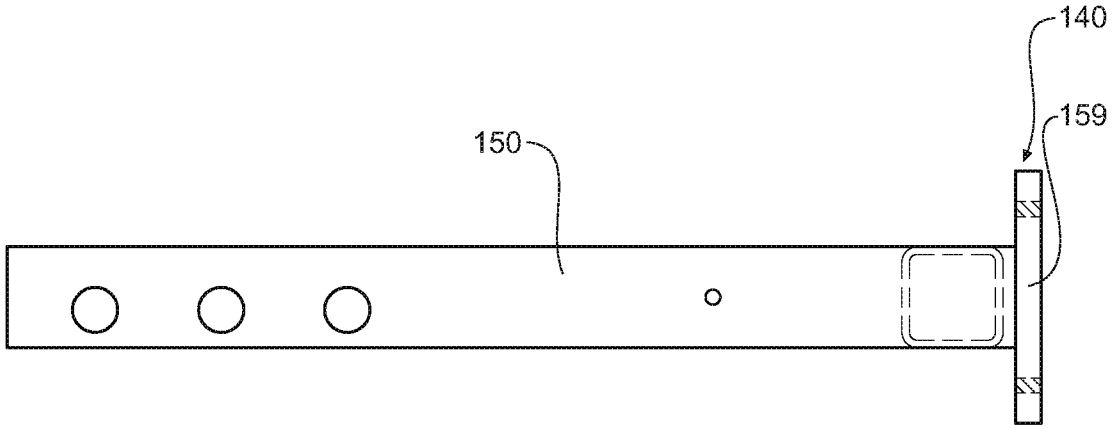
FIG. 25 is a side view of the end bracket of FIG. 24.

With reference to FIGS. 24 and 25, it can be seen that a second type of end bracket 140 comprises arms 150 of flat steel bar, and a connector 152 of SHS steel which is welded at its ends to the arms 150. The arms 150 of this end bracket 140 are thinner, and so the slot 154 therebetween is wider than that of the first type of end bracket 120, so that a larger, thicker beam 160 can be accepted within the slot 154 of the second type of end bracket 140. This end bracket 140 further comprises an end plate 159 via which this end bracket 140 can be secured with respect to other structure or formwork.

Figure 21:
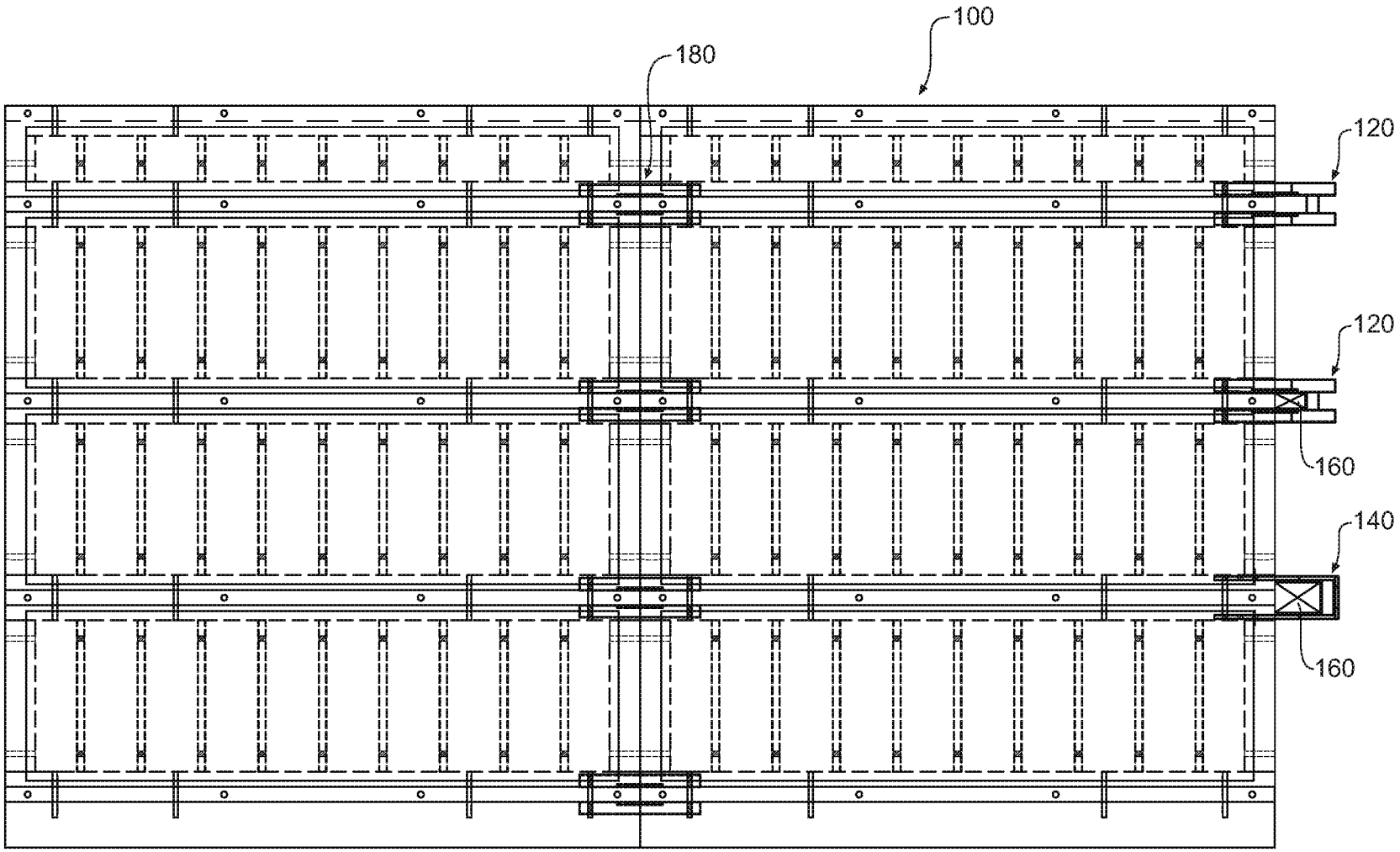
FIG. 21 illustrates a front view of a further formwork assembly for moulding an upwardly extending building feature, the formwork assembly comprising a plurality of the surface forming elements of FIG. 1.
Figure 26:
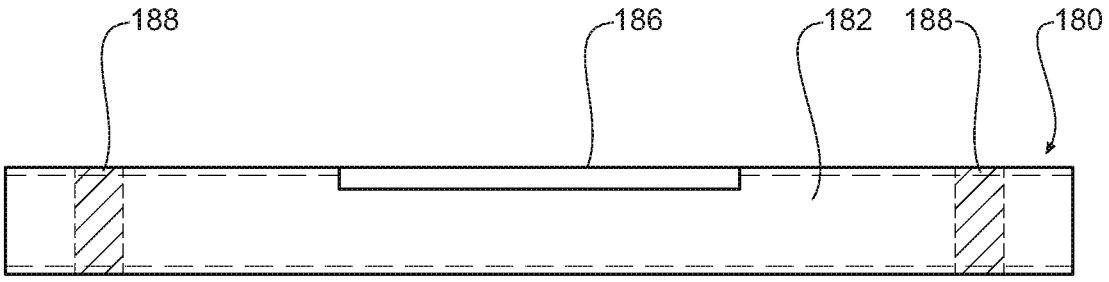
FIG. 26 is a plan view of a panel joiner from the assembly of FIG. 21.
Figure 27:
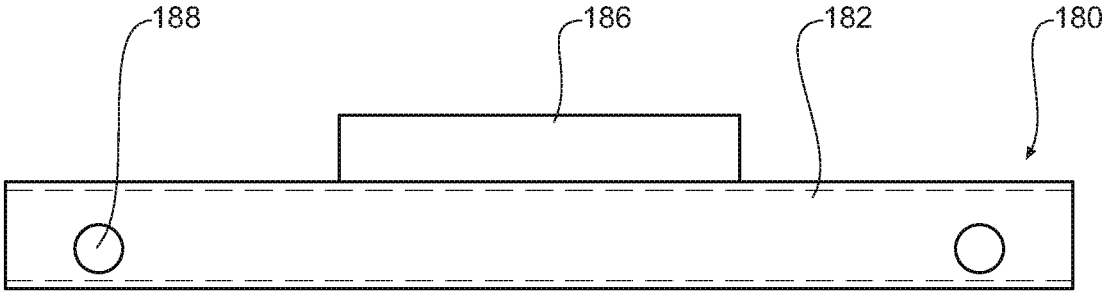
FIG. 27 is a side view of the panel joiner of FIG. 26.

With reference to FIGS. 26 and 27, where there is illustrated a panel end connector 180 for joining surface forming elements 1A end to end, as illustrated in FIG. 21. The panel end connector 180 comprises an elongate body 182 comprising a pair of opposing ends. In this embodiment, the elongate body 182 comprises a length of SHS steel. In use, a first end of the panel end connector 180 is inserted into an end of one of the tubular side members 12 of a first surface forming element 1A, and a second end of the panel end connector 180 is inserted into an end of one of the tubular side members 12 of a second surface forming element 1A. The panel end connector 180 further comprises a depth guide 186 which limits the depth to which the body 182 can be inserted into the tubular side members 12. In this embodiment, this depth guide 186 comprises a length of outwardly projecting steel plate which in use will abut against the rebate 16. The body 182 of the connector 180 further comprise holes 188 via which the connector 180 can be pinned or bolted in the side members 12.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A formwork assembly for moulding an upwardly extending building feature, the formwork assembly comprising at least two surface forming elements for forming one side of said building feature, each surface forming element comprising a rectilinear perimeter frame and an infill panel, and a continuous casting surface, said frame comprising at least a pair of lengthwise extending parallel side members, and a pair of parallel end members, each of the pair of lengthwise extending parallel side members comprising a means for interlocking the surface forming elements with respect to each other, said means comprising a profile shape which is substantially constant throughout a length of the lengthwise extending parallel edges, and which comprises at least one projection and at least one recess which is an inversion of the projection, and wherein, in use, the surface forming elements are stacked by abutting along the lengthwise extending parallel edges so that interlock is effected engagement of the projection of one element with the recess of the other, and vice versa, such that the resulting formwork assembly forms a single, continuous casting surface, and wherein the lengthwise extending parallel side members of the frame further comprise a plurality of apertures spaced apart there along, for receiving threaded fasteners, pins or the like to secure the stacked surface forming elements with respect to each other.

2. The formwork assembly of claim 1, wherein, in use, the surface forming elements extend substantially horizontally.

3. The formwork assembly of claim 1, wherein each surface forming element comprises a panel assembly.

4. The formwork assembly of claim 1, wherein the profile shape comprises a single projection and a single recess.

5. The formwork assembly of claim 4, wherein the profile shape comprises a squared step and a step-shaped recess adjacent to the squared step, wherein the step-shaped recess is shaped to receive a step of another surface forming element.

6. The formwork assembly of claim 1, wherein, for each surface forming element, the profile shape of one of the pair of lengthwise extending parallel edges is an inversion of the other of the pair of lengthwise extending parallel edges.

7. The formwork assembly of claim 1, wherein each surface forming element comprises means for securing a pair of surface forming elements with respect to each other in an end to end relationship.

8. The formwork assembly of claim 1, wherein the perimeter frame comprises a border extending around a perimeter of the infill panel to form the continuous casting surface along with the infill panel.

9. The formwork assembly of claim 8, wherein the border comprises a material having more wear resistance than the material of the infill panel.

10. The formwork assembly of claim 1, wherein the frame further comprises a plurality of spaced apart bracing members bridging the side members.

11. The formwork assembly of claim 1, wherein the end members of the frame comprise apertures for receiving at least one of threaded fasteners, pins, and the like to secure a pair of surface forming elements with respect to each other endwise.

12. The formwork assembly of claim 1, further comprising an edge element at the bottom of the assembly.

13. The formwork assembly of claim 12, further comprising an edge element at the top of the assembly.

14. The formwork assembly of claim 12, wherein each edge element comprises a pair of lengthwise extending parallel side edges, wherein a first side edge comprises a square edge for forming an end edge, and wherein a second side edge comprises a profile shape identical to that of the surface forming element such that a surface forming element can be stacked above and interlock with the second side edge.

15. The formwork assembly of claim 1, wherein the plurality of apertures in adjacent surface forming elements align when they are stacked, so that the threaded fasteners or pins can be inserted through the aligned apertures to secure an upper and a lower stacked surface forming element together.

16. A surface forming element for a formwork assembly for moulding an upwardly extending building feature, the surface forming element comprising at least two surface forming elements, each surface forming element comprising a rectilinear perimeter frame, an infill panel, and a continuous casting surface, said frame comprising at least a pair of lengthwise extending parallel side members, and a pair of parallel end members, each of the pair of lengthwise extending parallel side members comprising a means for interlocking the surface, forming elements with respect to another surface forming element, said means comprising a profile shape which is substantially constant throughout the length of the lengthwise extending parallel edges, and which comprises at least one projection and at least one recess which is an inversion of the projection, and wherein, in use, two or more surface forming elements are stacked by abutting along these edges so that interlock is effected by engagement of the projection of one element with the recess of the other such that the resulting formwork assembly forms a single, continuous casting surface, and wherein the lengthwise extending parallel side members of the frame further comprise a plurality of apertures spaced apart there along, for receiving threaded fasteners, pins or the like to secure the surface forming element with respect to another surface forming element.

* * * * *